US011220107B2

(12) United States Patent
Clark et al.

(10) Patent No.: US 11,220,107 B2
(45) Date of Patent: Jan. 11, 2022

(54) PRINTHEADS

(71) Applicant: Hewlett-Packard Development Company, L.P., Houston, TX (US)

(72) Inventors: Garrett E Clark, Corvallis, OR (US); Michael W. Cumbie, Corvallis, OR (US); Mark H. MacKenzie, Vancouver, WA (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 15/772,313

(22) PCT Filed: Feb. 5, 2016

(86) PCT No.: PCT/US2016/016783

§ 371 (c)(1),
(2) Date: Apr. 30, 2018

(87) PCT Pub. No.: WO2017/135968

PCT Pub. Date: Aug. 10, 2017

(65) Prior Publication Data

US 2018/0311956 A1 Nov. 1, 2018

(51) Int. Cl.

| | |
|---|---|
| ***B41J 2/05*** | (2006.01) |
| ***B41J 2/14*** | (2006.01) |
| ***B41J 2/045*** | (2006.01) |
| ***B41J 2/21*** | (2006.01) |

(52) U.S. Cl.

CPC ..... *B41J 2/14201* (2013.01); *B41J 2/0458* (2013.01); *B41J 2/04528* (2013.01); *B41J 2/04563* (2013.01); *B41J 2/04581* (2013.01); *B41J 2/1408* (2013.01); *B41J 2/14153* (2013.01); *B41J 2/2146* (2013.01); *B41J 2202/08* (2013.01); *B41J 2202/20* (2013.01)

(58) Field of Classification Search

CPC ..... B41J 2/04528; B41J 2/04563

See application file for complete search history.

(56) References Cited

U.S. PATENT DOCUMENTS

| | | | | |
|---|---|---|---|---|
| 5,025,267 | A | 6/1991 | Schofield et al. | |
| 5,168,284 | A | 12/1992 | Yeung | |
| 5,590,595 | A | 1/1997 | Thompson et al. | |
| 5,596,353 | A * | 1/1997 | Takada | B41J 29/393 347/14 |
| 6,068,363 | A * | 5/2000 | Saito | B41J 2/04541 347/17 |
| 6,491,375 | B1 | 12/2002 | Fitch | |
| 6,644,774 | B1 | 11/2003 | Burger et al. | |

(Continued)

FOREIGN PATENT DOCUMENTS

| | | |
|---|---|---|
| CN | 1576004 | 2/2005 |
| CN | 1292903 | 1/2007 |

(Continued)

*Primary Examiner* — Lam S Nguyen

(74) *Attorney, Agent, or Firm* — Law Offices of Michael Dryja

(57) ABSTRACT

The present disclosure includes a description of an example printhead having multiple ejection dies. The ejection dies are coupled to a temperature sensor and send temperature signals to a controller. The printhead can also include a heater coupled to the ejection dies to apply heat to at least one ejection die.

20 Claims, 4 Drawing Sheets

(56) References Cited

U.S. PATENT DOCUMENTS

| | | | | |
|---|---|---|---|---|
| 7,008,036 | B2 * | 3/2006 | Ju | B41J 2/04528 347/14 |
| 8,931,875 | B2 * | 1/2015 | Kosaka | B41J 2/04528 347/17 |
| 8,974,032 | B2 * | 3/2015 | Sasayama | G06K 15/027 347/15 |
| 2002/0067384 | A1 | 6/2002 | Anderson et al. | |
| 2004/0145619 | A1 | 7/2004 | Nishino | |
| 2005/0007403 | A1 | 1/2005 | Lee et al. | |
| 2005/0088474 | A1 | 4/2005 | Juve et al. | |
| 2009/0058914 | A1 | 3/2009 | Kim et al. | |
| 2010/0321439 | A1 | 12/2010 | Kanno et al. | |
| 2012/0013663 | A1 | 1/2012 | Snyder et al. | |
| 2013/0093809 | A1 | 4/2013 | Kosaka | |

FOREIGN PATENT DOCUMENTS

| | | |
|---|---|---|
| CN | 101480875 | 7/2009 |
| EP | 0816090 | 1/1998 |
| JP | 05269991 | 10/1993 |
| WO | WO-2015094161 | 6/2015 |

* cited by examiner

PRINTHEADS

BACKGROUND

Printing devices include systems and devices for applying printing material to print media. For example, some printing devices include print engines that generate spray patterns, droplets, or aerosols in a coordinated manner to generate a printed image when the printing device is moved relative to a print medium (e.g., paper, card stock, cardboard, fabric, etc.). Such print engines are often referred to as "inkjets" because they are said to jet or spray the printing material. Some inkjet print engines include an array of print nozzles used to selectively apply printing material to a region of the print media having a width corresponding to the width of the array. The array of print nozzles can be formed as a component of the print engine using various mechanical, optical, and/or semiconductor manufacturing processes.

DETAILED DESCRIPTION

The components of the printing system that include arrays of print nozzles are often referred to as a "inkjet dies" or "ejection dies". The temperature of the ejection dies can have an effect on the performance of the ejection die. For example, the drop weight, dot size, or print density of the printing material ejected from a particular ejection die can depend or vary based on the temperature of the die at the time of ejection. According to various implementations of the present disclosure, the temperature of the ejection dies can be controlled by including a corresponding temperature sensor or heat sensor, to detect the temperature of the dies, and a corresponding heater that can be used to adjust the operational temperature of the dies. Using the information from the temperature sensor, and information received from other components of a printing system, implementations of the present disclosure can adjust the temperature of individual ejection dies, groups of ejection dies, or print heads to help ensure acceptable levels of print quality from printheads and/or ejection dies that may otherwise be operating at different or sub optimal temperatures.

Figure 1:
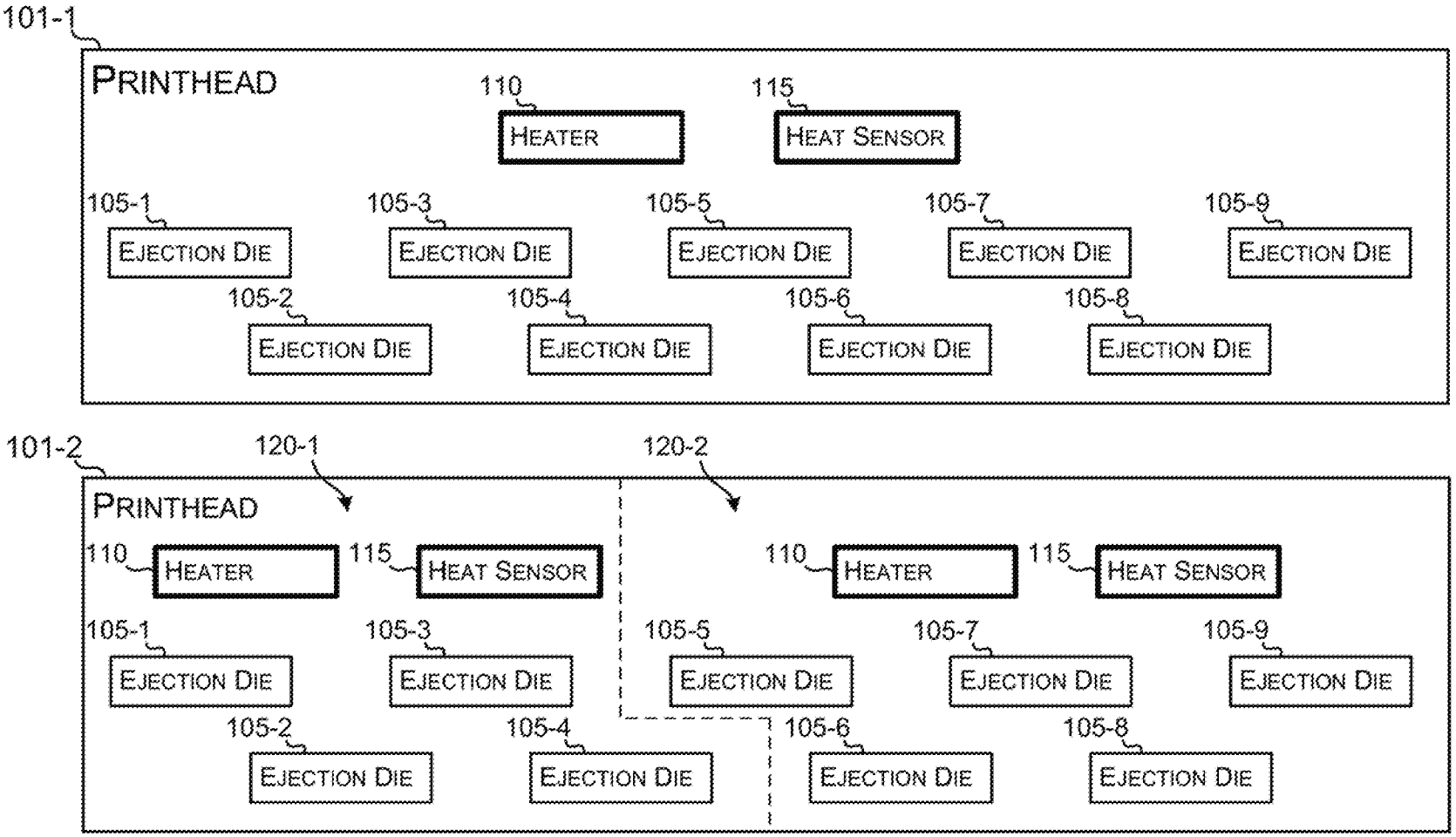
FIG. 1 depicts schematic representations two example printheads.

FIG. 1 depicts two example printheads 101 according to various implementations of the present disclosure. As described herein, printheads 101 can include ejection dies 105. Each ejection die 105 can include a corresponding array of print nozzles. Each of the print nozzles can be individually activated to selectively generate sprays, droplets, or aerosols of the printing material. Accordingly, each individual array of print nozzles and/or any combination of the ejection dies 105 can be operated in coordination to generate a printed image on the surface of a print media as it moves relative to the printhead 101.

In some implementations, a printhead 101 can be implemented as illustrated in FIG. 1 to form a wide array of ejection dies 105. In the particular example shown, each of the ejection dies 105, and corresponding arrays of print nozzles, can be arranged across the length of the printhead 101 to form what is referred to herein as an "page wide array" of print nozzles. A page wide array can be dimensioned and include multiple ejection dies 105 to span a dimension corresponding to a maximum dimension of print media with which the printhead 101 will be used. For example, a page wide array that includes one of the example printheads 101 can be dimensioned and include a particular number of ejection dies 105 to span the width A4 paper. As such, the page wide array of a printhead 101 can apply printing material to generate a printed image across the full width of a print media in a single pass.

The ejection dies 105 can include print nozzles that utilize various types of ejection mechanisms. In some example implementations, the print nozzles can include an inkjet type ejection mechanism. The inkjet ejection mechanism can be a thermal or piezoelectric ejection mechanism. The performance of the print nozzles, regardless of the ejection mechanism, can depend on the operating temperature of the ejection dies. For example, the print nozzles of a particular ejection die 105 can either eject more or less printing material (e.g., ink) in response to a particular control signal depending on the temperature of the ejection die 105. In some implementations, the print nozzles may eject more printing material when the ejection die 105 is warmer than some nominal operating temperature, while in other implementations, the print nozzles may eject more printing material when the ejection die 105 is colder than some nominal operating temperature.

According to various implementations of the present disclosure, to better control the amount of printing material ejected by the print nozzles of the ejection dies 105, example printheads 101 can include a heater 110 and a temperature sensor 115. The heat 110 can include any resistive or inductive heating element, infrared heater, or the like. Temperature sensor 115 can include any type of contact temperature sensor (e.g., thermistor, thermocouple, etc.) or noncontact temperature sensor (e.g., infrared sensor).

The example printhead 101-1 includes a single heater 110 and a single temperature sensor 115 for the multiple ejection dies 105. The example printhead 101-2 includes one heater 110 and one temperature sensor 115 for each grouping 120 of ejection dies 105. An example shown, printhead 101-2 includes a first zone 120-1 that includes ejection dies 105-1 through 105-4 and a corresponding heater 110 and temperature sensor 115, and a second zone 120-2 that includes ejection dies 105-5 through 105-9 and another corresponding heater 110 and temperature sensor 115. As such, the temperature sensor 115 in this first zone 120-1 can sense the temperature of the individual ejection dies 105-1 through 105-4 and/or the temperature of the group of ejection dies 105-1 through 105-4. Similarly, the temperature sensor 115 and the second zone 120-2 can sense the temperature of the individual ejection dies 105-5 through 105-9 and/or the temperature of the group of ejection dies 105-5 through 105-9. In a similar manner, the heaters 110 can apply heat to each individual ejection die 105 in a corresponding zone 120 or printhead 101, or apply heat to a group of ejection dies 105 in a particular zone 120, as in printhead 101-2, or across the entire printhead, as illustrated in printhead 101-1.

In some implementations, the ejection dies 105 include various materials, such as metals, plastics, ceramics, and the like. In such implementations, the ejection dies 105 can include a range of thermal conductivity characteristics. The ejection dies 105 can be supported in a housing or frame structure. The heater 110 and temperature sensor 115 can also be supported in the same housing or frame structure. In various implementations, the housing or frame structure can also include elements for storing printing material and elements for feeding the printing material to the ejection dies 105. The printing material storing elements can include a reservoir or container. The feed elements, can include various ducts for channels for feeding the printing material from the reservoir or container to the ejection dies 105. In some implementations, the printing material is gravity fed from other reservoirs through the channels to the ejection dies 105.

While an example number of ejection dies 105 are illustrated in the example printheads 101-1 and 101-2, various implementations the present disclosure can include more or fewer ejection dies 105. Similarly, while the example printhead 101-2 is depicted as having two groups or zones 120 of ejection dies 105 and corresponding heaters 110 and temperature sensors 115, other implementations the present disclosure can include more groups or zones 120 of ejection dies 105. The more zones 120 and corresponding heaters 110 and temperature sensors 115 that are included in a particular printhead 101 can provide for more granular control of the ejection dies 105 across the printhead 101.

Figure 2:
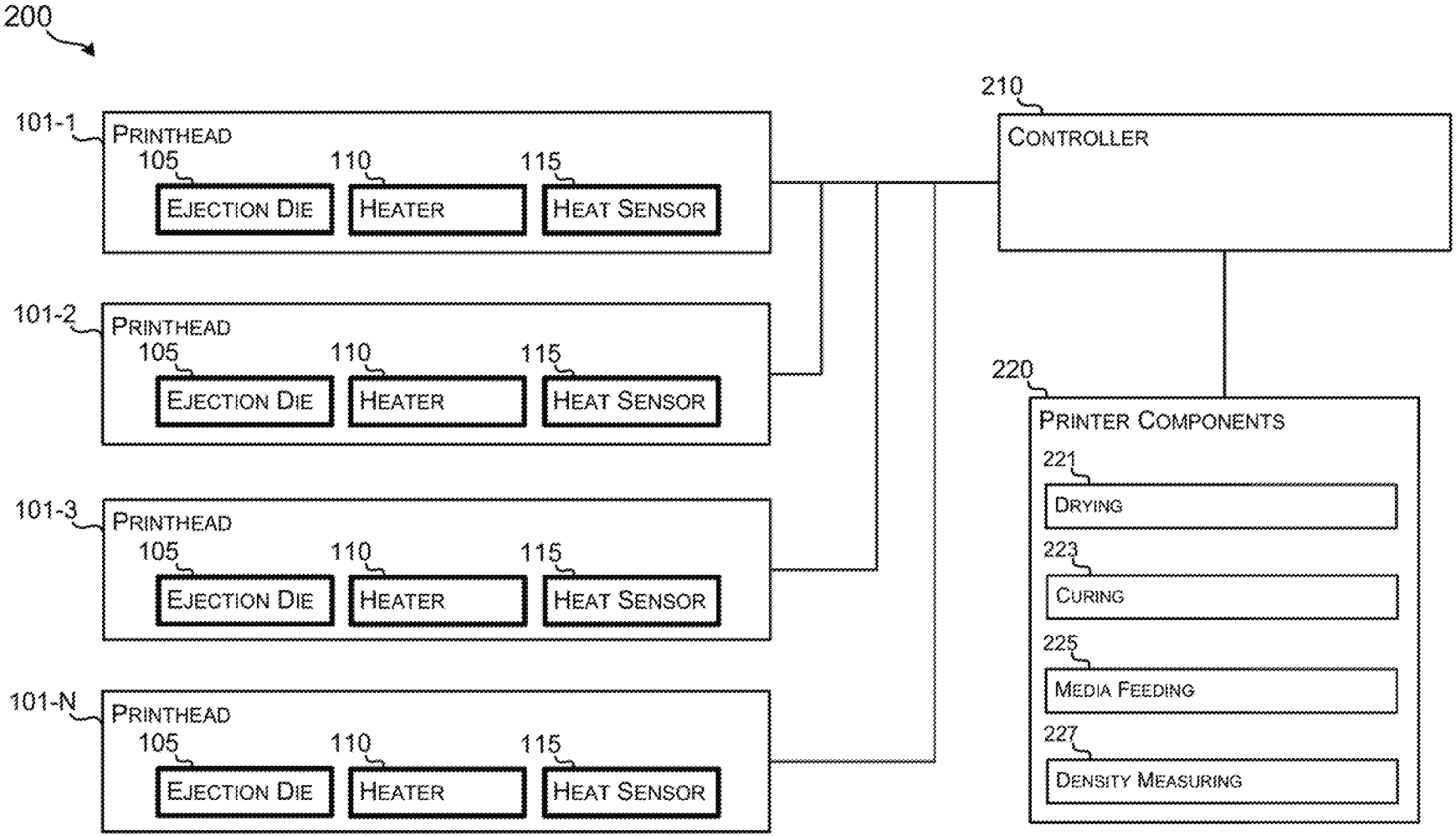
FIG. 2 depicts a schematic representation of an example printhead temperature control system.

In various example implementations, each printhead 101 can be associated with a particular printing material. For example, a printhead 101 can be devoted to the application of a single color ink or pigment to a print media. Accordingly, to generate a monochrome or single color image, a printing device may only need a single printhead 101. Alternatively to generate a multiple color image, a printing device may include multiple printheads 101 for applying different color features to the print media. FIG. 2 depicts an example printing system 200 that includes multiple printheads, according to a particular implementation of the present disclosure.

As illustrated in FIG. 2, the example printing system 200 can include multiple printheads 101, the controller 210, and various other printer components 220. As shown, each of the printheads 101 can be coupled to the controller 210. Similarly, each of the printer components 220 can also be coupled to the controller 210. For simplicity and clarity, each of the printheads 101-1 through 101-N, where N is an integer, is depicted with a single ejection die 105 that can represent a single or multiple ejection dies 105. Similarly, each of the printheads 101-1 through 101-N is depicted with a single heater 110 and a single temperature sensor 115, each of which can represent a single or multiple corresponding heaters 110 and/or temperature sensors 115. Also, as described in reference to FIG. 1 and example printhead 101-2, in implementations in which a printhead 101 includes multiple heaters 110 and/or multiple temperature sensors 115, the ejection dies 105 can be grouped into corresponding groups or zones 120 that are associated with a corresponding heater 110 and/or temperature sensor 115.

In various implementations described herein, the controller 210 can be implemented as any combination of hardware and executable code. For example, the functionality of the controller 210 described herein can be implemented as executable code executed in a processor of computer system or other computing device.

The executable code, stored on a nonvolatile computer readable medium, can include instructions for operations that when executed by a controller 210 causes the controller 210 to implement the functionality described in reference to the controller 210 and/or its subcomponents. Accordingly, controller 210 can be implemented in a system comprising a processor, a memory, a communication interface, and/or other digital or analog logic circuits that can be used to store and/or execute operations defined by executable code or code segments.

The processors of the system may be a microprocessor, a micro-controller, an application specific integrated circuit (ASIC), or the like. According to an example implementation, the processor is a hardware component, such as a circuit.

The memory can include any type of transitory or non-transitory computer readable medium. For example the memory can include volatile or non-volatile memory, such as dynamic random access memory (DRAM), electrically erasable programmable read-only memory (EEPROM), magneto-resistive random access memory (MRAM), memristor, flash memory, floppy disk, a compact disc read only memory (CD-ROM), a digital video disc read only memory (DVD-ROM), or other optical or magnetic media, and the like, on which executable code may be stored. In various implementations, the memory can be included in a printhead 101 for storing an associated print performance profile or other settings data that includes the temperature dependencies or temperature set points for that printhead.

The printer components 220 can represent any and all other heat generating elements of the printing system 200 and/or any elements meant to cool the printing system 220. For illustrative purposes, an example set of printer components 220 are depicted in FIG. 2. The example printer components 200 can include a drying component 221, a curing component 223, a media feeding component or system 225, and a print density measuring component 227. The drying component 221 can include any element meant to remove excess moisture or solvent from a printed image generated by the printheads 101. Such a drying components 221 can include devices or mechanisms such as a fan, a heating element, blotters, and the like. The curing component 223 can include any element for fixing or curing the printing material applied by the printheads 101. Example curing components 223 include devices such as radiant energy sources, such as infrared lamps. UV light sources, and the like. The media feeding component or system 225 can include various combinations of motorized rollers, motorized conveyor belts, motorized star wheels, etc. Printed image density measuring components 227 can include various optical sensors and imaging systems that can detect the density of printing material deposited on a print media by the printheads 101.

Any and all of the printer components of the example printing system 200 can generate various amounts of heat that can affect the performance of the ejection dies 105. In some scenarios, the operation each of the individual ejection die 105 can affect its own temperature, the temperature of its neighboring ejection dies 105, as well as the temperature of ejection dies 105 on another printhead 101. For example, in various printing scenarios a particular ejection die 105, or group of ejection dies 105, can be caused to eject more printing material than other ejection dies 105. Accordingly, those ejection dies 105 that are used more than the other ejection dies 105 can tend to be hotter than the ejection dies 105 that are the used less often. Because the temperature of ejection dies 105 can impact the performance of ejection dies 105, it is helpful to be able to monitor the temperature of the ejection dies 105 and be able to compensate for correct for temperature variation beyond the range of predetermined operating temperatures. In some implementations, the range of predetermined operating temperatures can be based on a predetermined or calibrated level of performance associated with the ejection dies 105. For example, a particular type or design of ejection dies 105 can be designed or optimized to function at a particular level (e.g., eject predictable amounts of ink or pigment) when operated within a particular range of temperatures.

As described herein, each printhead 101 can include a heater 110 and/or temperature sensor 115. Before, during, and after normal operation of the printing system 200 (e.g., during calibration, printing operations, finishing operations, shutdown, etc.) the controller 210 can send control signals to the printheads 101 to activate the corresponding heaters 110 to various setpoints to preheat, maintain, or cool off their associated ejection dies 105. For example, the controller 210 can send control signals to the heaters 110 to cycle on and off to maintain the ejection dies 105 at a temperature within a predetermined range of temperatures. In some implementations, the controller 210 can send control signals to the heaters 110 to preheat the ejection dies 105 to a predetermined temperature before the controller 210 activates the printheads 101 for printing operations. Such preheating can help avoid transient diminished or sub optimal performance of the printheads 101 and/or the ejection dies 105.

As the printing system 200 performs various operations, the controller 210 can receive temperature information from temperature sensors 115, compare the temperature information to a particular predetermined range of temperature information, and then send corrective signals to the corresponding heaters 110 to turn on, turn off, or cycle according to particular pattern, to maintain or increase the temperature of the corresponding ejection dies 105.

As described herein, the controller 210 can be coupled to various printer components 220. As the controller 210 performs operations to control the printer components 220, they can also receive information from the printer components 220. Such information, or feedback, can include information regarding the temperature or other operating conditions of the drying component 221, the curing component 223, the media feeding system 225 and/or the density measuring component 227. For example, the controller 210 can receive information from the drying component 221 and/or the curing component 223 that they are operational and generating heat that may affect the operational temperature of the ejection dies 105 in various printheads 101. Based on this information, the controller 210 can immediately begin monitoring the temperature sensors 115 and/or increase the frequency with which the temperature sensors 115 or reporting temperature information.

In some implementations, the controller 210 can control the density measuring component 227 to measure the density of the printing material of any one of the ejection dies 105 on any one of the printheads 101 during calibration or during normal operations. For example, the density measuring component 227 can measure the print density or dot size of the printing material applied by a particular ejection die 105 over some particular printed area. Based on information of the print density or dot size in the area measured, the controller 210 can determine the print density and correlated with the operational temperature determined by a corresponding temperature sensor 115. The controller 210 can then perform operations to compensate for any changes in ejection die 105 performance by operating (e.g., activating or deactivating) a corresponding heater 110.

In various implementations, the controller 210 can access stored setting files stored on each of the printheads 101 and/or a memory included (not shown) in the printing system 200 to retrieve predetermined target temperatures for each ejection die 105 and/or group or zone of ejection dies 105 on the printheads 101. Using the information in the setting files, the controller 210 can operate the heaters 110 and temperature sensors 115 to set the corresponding ejection dies to a particular predetermined temperature associated with each ejection die 105 or group of ejection dies 105.

In similar implementations, the controller can adjust the temperature of the ejection dies 105 in a particular printhead 101 to compensate for or to achieve uniform performance based on variations in the performance of the ejection dies 105 across different printheads 101. In such implementations, the controller 210 can use the density measuring component 227 to determine feedback information on which you can base compensating heating profiles for any of the printheads 101 and/or the component ejection dies 105. In other implementations, the controller 210 can reference setting information and or performance profiles that associate temperature with particular performance characteristics (e.g., dot size, print density, etc.) of the ejection dies 105 and/or groups of ejection dies 105 in a particular printhead 101 to obtain temperature settings which to operate heaters 110 and temperature sensors 115 to achieve consistent and/or uniform performance across the ejection dies 105 and/or across printheads 101.

By providing the capability for the controller 210 to set an/or adjust the temperature of the ejection dies 105 across the printheads 101, a printing system 200 can advantageously adjust the dot size or printing material drop weight instead of using a complex system that adjust the number of printing material drops ejected. The ability to compare the temperature of ejection dies 105 between printheads 101 provides the ability to control variation in the print performance when an ejection die or group of ejection dies 105 in one printhead 101 is warmer than its initial temperature set point due to operational conditions of the printing system 200. To compensate for the change in print performance, the controller 210 can increase the temperature of the ejection dies 105 or groups of ejection dies 105 on other printheads 101.

Figure 3:
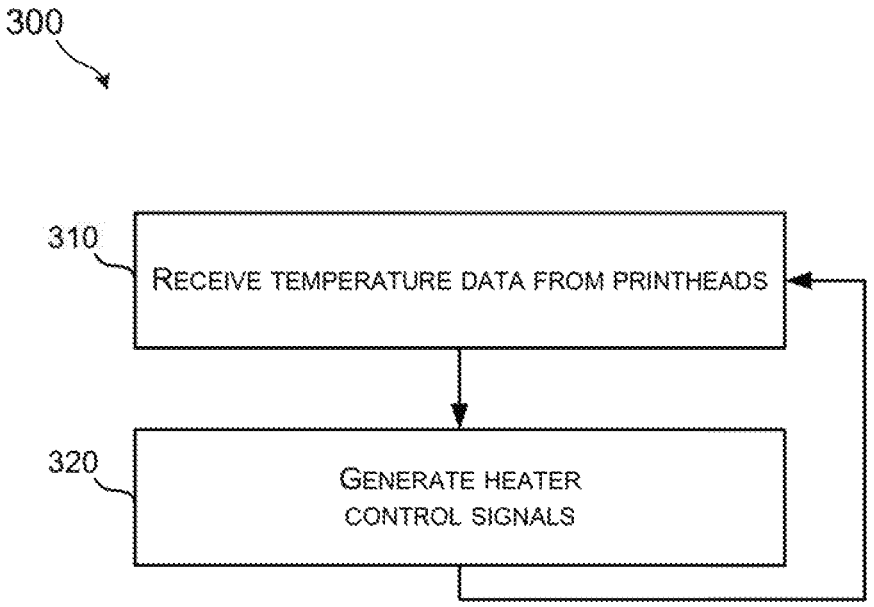
FIG. 3 is a flowchart of an example method for operating printhead temperature control system.

FIG. 3 depicts a flowchart of an example method 300 controlling the temperature of ejection dies 105 according to various implementations of the present disclosure. As shown, the method 300 can begin at box 310 in which the controller 210 receives the temperature data from printheads 101. As described herein, the temperature data can be received from a temperature sensor 115 included in the printhead 101. The temperature sensor 115 can be associated with a particular ejection die 105, and/or group of ejection dies 105. In addition, the temperature sensor 115 can also be associated with a particular heater 110. The temperature data can include information about the current, historic, or future operational temperature of the particular ejection die 105 and/or group of ejection dies 105.

Based on the temperature data, the controller 210 can generate heater control signals that either turn on, turn off, an/or cycle on and off the heater 110 associated with the relevance ejection dies 105, at box 320. In some implementations, generating the heater control signals can include referencing setting data and/or performance profiles associated with the particular printhead 101, the particular ejection dies 105 and/or groups of ejection dies 105. As described herein, the setting data and/or performance profiles operational settings or performance curves that associate the printing material drop weight, dot size, or density performance of an ejection die 105 and/or group of ejection dies 105 with an operational temperature for a particular set of control signals. The control signals, as described herein, refer to the set of electronic signals, such as voltages, currents, or the like, that the controller 210 sends to the printhead 101 to drive print nozzles in a particular ejection die 105 and recorded in manner to generate a printed image. As such, control signals can include different levels or sets of signals (e.g., bias voltages, activation voltages, etc.) with which the ejection dies 105 are operated. Accordingly, different levels of control signals can be associated with corresponding setting data and/or performance profiles.

Figure 4:
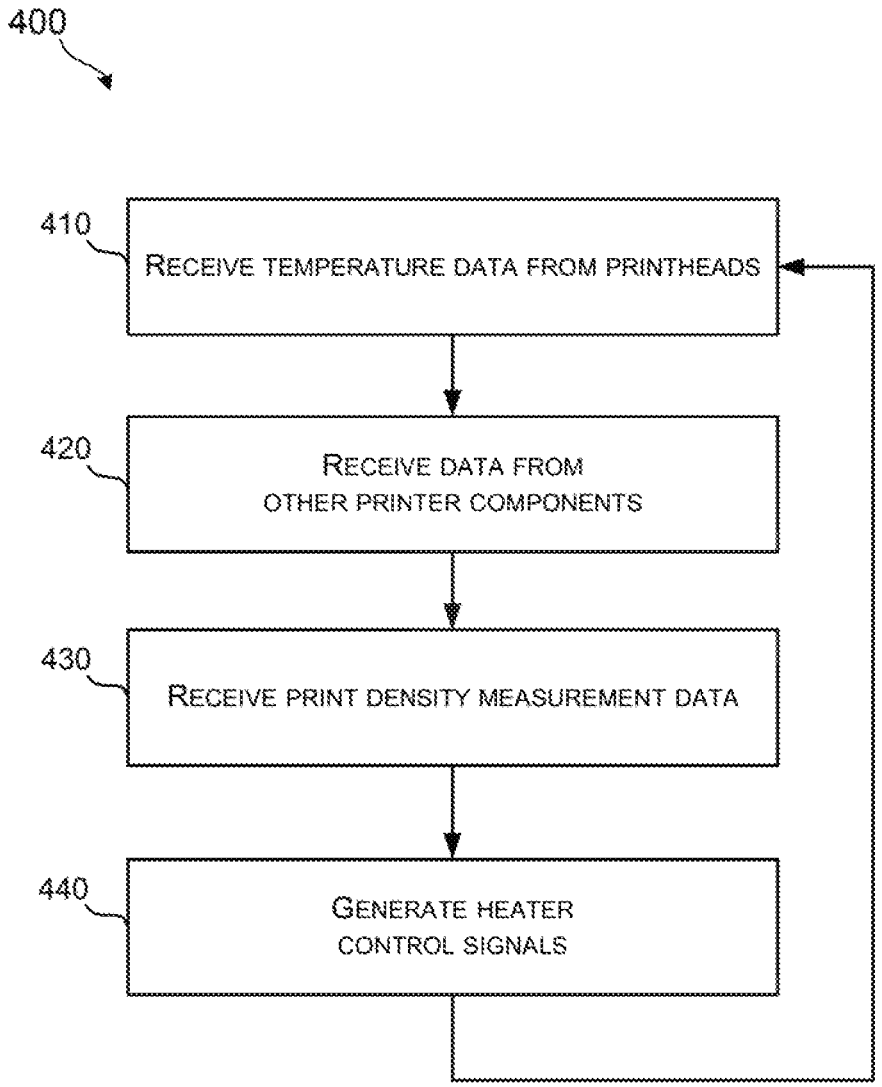
FIG. 4 is a flowchart of an example method for operating printhead temperature control system.

FIG. 4 is a flowchart of an example method 400 for controlling the temperature of ejection dies 105 according to various implementations of the present disclosure. As shown, the method 400 can begin at box 410 with the controller 210 receiving temperature data from printheads 101. The temperature data from the printheads 101 can be received from a temperature sensor 115 and correspond to temperatures of component ejection dies 105. At box 420, the controller can receive data from other printer components 220. The data received from the printer components 220 can include information indicating the operation of the components, such as the current functions being performed by the components, the current temperature of the components, current operational status of the components, and the like. For example, the data received from the printer components 220 can include information regarding the current state (e.g., temperature, airspeed, fault detection, etc.) of the drying component 221, the current states (e.g., temperature, radiant energy output, fault detection, etc.) curing component 223, or the current state (e.g., temperature, motor speed, belt speed, jam detection, etc.) of the media feeding system 225.

At box 430, the controller 210 can receive print density measurement data regarding measurements determined by the density measuring component 227. Such measurements can include measurements of the dot size, density, or other print quality information of images printed by the printheads 101 or information about content that will be printed in the future as detected by the density measurements component 227.

At box 440, the controller 210 can generate heater control signals with which to control the heaters 110 and/or temperature sensors 115 in the various printheads 101 and the printer system 200. For example, the heater control signals can include signals that cause the heaters 110 to turn on, turn off, and/or cycle on and off to set or reset temperature set points of the component ejection dies 105 to improve or control the print performance of the ejection dies 105.

These and other variations, modifications, additions, and improvements may fall within the scope of the appended claims(s). As used in the description herein and throughout the claims that follow, "a", "an", and "the" includes plural references unless the context clearly dictates otherwise. Also, as used in the description herein and throughout the claims that follow, the meaning of "in" includes "in" and "on" unless the context clearly dictates otherwise. All of the features disclosed in this specification (including any accompanying claims, abstract and drawings), and/or all of the elements of any method or process so disclosed, may be combined in any combination, except combinations where at least some of such features and/or elements are mutually exclusive.

What is claimed is:

1. A printer system comprising:

a controller including a circuit;

a printhead including:

a plurality of ejection dies that each include a plurality of thermal ejection mechanisms that eject printing material responsive to ejection control signals;

a temperature sensor coupled to the plurality of ejection dies to send temperature signals to the controller; and a heater coupled to the plurality of ejection dies to apply heat to at least one ejection die in the plurality of ejection dies based on heater control signals from the controller without causing the thermal ejection mechanisms to eject the printing material; and a density measurement component, including a sensor, to detect density of the printing material deposited on a print media by the printhead and to provide feedback data indicative of the detected density and variation in density to the controller, the controller to:

provide the heater control signals to the heater; and adjust the heat that the heater applies to the at least one ejection die based on the density detected by the density measurement component and based on the temperature signals sent by the temperature sensor, by modifying the heater control signals, to compensate for changes in the at least one ejection die.

2. The printer system of claim 1 wherein the heater applies heat to the at least one ejection die based on the heater control signals received from the controller in response to the temperature signals.

3. The printer system of claim 1 wherein the ejection dies are associated with corresponding performance profiles comprising temperature based settings, the performance profiles including performance characteristics resulting from different temperatures of the ejection dies.

4. The printer system of claim 1 wherein the plurality of ejection dies is one group of ejection dies and a plurality of ejection dies included in the printhead.

5. The printer system of claim 1 further comprising a memory having a print performance profile associated with the plurality of ejection dies, wherein the temperature sensor is to monitor temperatures associated with each of the plurality of ejection dies and the controller is to provide the heater control signals to the heater to adjust a first temperature of the at least one ejection die based on a second temperature of a neighboring ejection die of the plurality of ejection dies.

6. The printer system of claim 1, further comprising a drying component to remove excess moisture or solvent from a printed image generated by the printhead and to provide feedback data to the controller, and the controller is to monitor the temperature sensor in response to the feedback data being indicative of the drying component being operational and generating heat.

7. The printer system of claim 1, further comprising a curing component to fix or cure the printing material applied by the printhead and to provide feedback data to the controller, and the control is to monitor the temperature sensor in response to the feedback data being indicative of the curing component being operational and generating heat.

8. The printer system of claim 1, further comprising a media feed component, and to provide data to the controller indicative of a current state of the media feed component, and the control is to monitor the temperature sensor based on the current state.

9. A printer system comprising:

a controller to generate heater control signals and ejection control signals, the controller including a circuit;

a plurality of printheads coupled to the controller, each printhead comprising:

an ejection die including a plurality of thermal ejection mechanisms to eject printing material in response to the ejection control signals received from the controller;

a temperature sensor to send temperature data to the controller, the temperature data being indicative of a temperature associated with the ejection die; and a heater to apply heat to the ejection die in accordance with the heater control signals received from the controller based on the temperature data without causing the thermal ejection mechanisms to eject the printing material; and a density measurement component, including a sensor, to detect density of printing material deposited on a print media by the plurality of printheads and to provide data indicative of the detected density to the controller, the controller to modify the heater control signals to adjust the heat that the heater applies to the ejection die based on the detected density and the temperature data.

10. The printer system of claim 9 further comprising additional printer components to perform corresponding functions and to send status data to the controller, and wherein the heater control signals generated by the controller are further based on the status data, and the controller is to monitor the temperature sensors in response to the status data being indicative of the additional printer components being operational and generating heat.

11. The printer system of claim 9 wherein the ejection die comprises a plurality of ejection dies, and the temperature sensor is to monitor and send temperature data to the controller, the temperature data being indicative of different temperatures associated with respective ones of the plurality of ejection dies.

12. The printer system of claim 9 wherein the temperature sensor measures the temperature of the ejection die and the temperature data is based on the measures, and the heater of each printhead is to adjust the temperature of the respective ejection die in response to the heater control signals.

13. The printer system of claim 9 wherein each printhead is to store a temperature performance profile associated with the printhead, and wherein the controller is to correlate the detected density with the temperature data from the temperature sensor and to send the heater control signals to adjust the temperature of the ejection die and to adjust a performance characteristic associated with the ejection die based on the detected density, the performance characteristic including a dot size, a print weight, and a combination thereof.

14. A method comprising:

receiving temperature data from a printhead having a plurality of ejection dies that each include a plurality of thermal ejection mechanisms that eject printing material responsive to ejection control signals;

generating heater control signals based on the temperature data to control heaters on the printhead that heat the ejection dies without causing the thermal ejection mechanisms to eject the printing material;

receiving print density measurement data from a density measurement component, including a sensor, the print density measurement data being indicative of variations in density of material printed by respective ones of the ejection dies; and adjusting the heat that the heaters apply to the ejection dies based on the print density measurement data received from the density measurement component, by modifying the heater control signals, to compensate for changes in the ejection dies.

15. The method of claim 14, wherein the temperature data comprises data corresponding to a temperature of an ejection die on the printhead, and the method further includes adjusting, by the heaters, a temperature associated with the printhead in response to the heater control signals.

16. The method of claim 14, further comprising receiving status data from another printer component, and wherein the heater control signals are further based on the status data.

17. The method of claim 14, wherein the heater control signals are further based on a performance profile associated with the printhead, the performance profile including an association between different temperatures of the printhead and performance characteristics, and the method further includes controlling printer performance by adjusting the temperature of the printhead to adjust the performance characteristics in response to the heater control signals.

18. The method of claim 14, further including the printhead storing a temperature performance profile associated with the printhead, the method further including: receiving additional temperature data from a second printhead, the printhead and second printhead forming part of a printing system, wherein the heater control signals are further based on the additional temperature data from the second printhead.

19. The method of claim 14, further including receiving status data from another printer component, and receiving print density measurement data from the density measurement component, wherein the heater control signals are further based on the status data and on the print density measurement data.

20. The method of claim 14, further including:

the printhead storing a temperature performance profile associated with the printhead;

receiving status data from another printer component; and receiving print density measurement data from a density measurement component;

wherein the heater control signals are further based on the status data and on the print density measurement data.

* * * * *